US007377052B2

(12) United States Patent
Maruca

(10) Patent No.: US 7,377,052 B2
(45) Date of Patent: May 27, 2008

(54) LOW TEMPERATURE CLOTHES DRYER

(76) Inventor: Robert E. Maruca, 5945 South River Rd., Stanardsville, VA (US) 22973

( * ) Notice: Subject to any disclaimer, the term of this patent is extended or adjusted under 35 U.S.C. 154(b) by 0 days.

(21) Appl. No.: 11/707,083

(22) Filed: Feb. 16, 2007

(65) Prior Publication Data

US 2007/0144032 A1 Jun. 28, 2007

Related U.S. Application Data

(62) Division of application No. 10/869,898, filed on Jun. 18, 2004, now Pat. No. 7,191,546.

(51) Int. Cl.
*F26B 25/06* (2006.01)

(52) U.S. Cl. ..... 34/201; 34/202; 34/212; 34/219; 34/233; 34/240; 34/572; 236/44 C; 62/176.6

(58) Field of Classification Search ..... 34/201, 34/202, 209, 210, 212, 215, 218, 219, 224, 34/225, 232, 233, 240, 603, 604, 138, 549, 34/572; 62/176.1, 176.6; 236/44 A, 44 C
See application file for complete search history.

(56) References Cited

U.S. PATENT DOCUMENTS 3,866,336 A 2/1975 Bereza
5,152,077 A * 10/1992 Liang ..... 34/219
5,555,640 A 9/1996 Ou
5,755,040 A 5/1998 Ou ..... 34/202
5,870,836 A 2/1999 Grimes
6,005,227 A 12/1999 Pappas
6,845,569 B1 * 1/2005 Kim ..... 34/202

FOREIGN PATENT DOCUMENTS

EP 0 094356 A1 11/1983
JP 4089099 3/1992
JP 06007597 A 1/1994
JP 09101069 A 4/1997

* cited by examiner

*Primary Examiner*—Jiping Lu
(74) *Attorney, Agent, or Firm*—Richard C. Litman

(57) ABSTRACT

A low temperature clothes dryer having a drying chamber provides removable horizontal screens supporting clothing items and a hanging bar for hanging clothes to be dried. A timing control allows setting the time of operation of the drying cabinet. An electric heater with thermostat is provided to initially raise and maintain the air temperature within the drying chamber to at least about 90 degrees F. The dehumidifier is then operated, providing for circulation through the ducts and drying cabinet by an internal fan. The dehumidifier has an evaporator through which warm, humid air is passed, thereby cooling the air and condensing water therefrom, the water being collected in a removable container or drained through a drain hose. The fan forces the cooled, dried air through a condenser which heats the dried air for recirculation through the drying chamber by means of ducts, thereby drying the clothing therein.

5 Claims, 7 Drawing Sheets

LOW TEMPERATURE CLOTHES DRYER

CROSS REFERENCE TO RELATED APPLICATION

This application is a division of application Ser. No. 10/869,898 filed Jun. 18, 2004, now U.S. Pat. No. 7,191,546.

BACKGROUND OF THE INVENTION

1. Field of the Invention

The present invention relates to low temperature evaporative clothes dryers. More particularly, the present invention relates to clothes drying cabinets employing circulating drying air from an air dehumidifier.

2. Description of the Related Art

The use of cabinet type clothes dryers is well known, particularly for woolens and delicate items which are harmed by conventional tumble dryers. Also, in locations where energy is at a premium, cabinet dryers may be more energy efficient than conventional clothes dryers. In cabinet dryers the clothes are either hung as in clothes cabinets or laid flat on supports. Such dryers may simply circulate outside air through the cabinet in cases where the outside air is relatively dry. Heaters may also be used to heat the air supplied to the cabinet. In the most sophisticated embodiments, air is at least partially recirculated through the cabinet and a dehumidifier removes moisture from the recirculating air so as to maintain a supply of drying air.

Recirculation insures that heat energy supplied by heaters or the heat added by the condenser of the dehumidifier is retained in the drying cabinet system. Such cabinet systems are preferably made from wood or other insulative material to conserve heat energy in the system. Previous systems do not provide for fully closed recycle of the drying air, allowing for entrance and/or exit of air to the environment. The operation of these systems is dependent on the temperature and humidity of the environmental air. Some systems are not effective in highly humid air or in low environmental temperatures where the evaporator tends to freeze up with ice. They require complicated cooling systems and vents to avoid buildup of heat in the system which would lead to damage of the clothing to be dried. It would be desirable to provide a recirculating air clothes drying cabinet having a closed system which operates independent of the environmental air conditions. Such a system would operate effectively within a wide range of environmental temperatures with minimal energy usage.

European patent document No. 0 094 356 A1, published Nov. 16, 1983, describes a clothes drying cabinet having a drying chamber, a circulating fan, and a heat pump that serves as both a dehumidifier and a heater. The heat pump includes a compressor, a condenser that acts as a heater, and an evaporator that acts as a dehumidifier. Air is circulated by the fan into the cabinet through an inlet, is heated by the condenser, circulated across the clothing in the drying chamber, and directed to a cooling channel where the humidity is removed from the air by the evaporator and allowed to collect in a collection bin.

Japanese patent document No. 40899099, published Mar. 23, 1992, describes a clothes dryer having a main cabinet body, a dehumidifier, and a heater. Air is circulated throughout the system by a fan. A temperature sensor is operated to regulate the temperature in the cabinet body and opens either suction ports or exhaust ports when the temperature in the chamber becomes too high. The clothing may be dried on hangers or on a drying shelf.

U.S. Pat. No. 6,005,227, issued Dec. 21, 1999, to Pappas, describes a towel warmer console cabinet having a circulating fan and an electric heater and teaches that it is known to re-circulate air within the cabinet instead of drawing in ambient air and exhausting humidified air.

U.S. Pat. No. 3,866,336, issued Feb. 18, 1975, to Bereza, describes a cabinet-type laundry dryer and teaches that the heat source may be external to the cabinet such that warm air is directed into the cabinet by a duct from a household heating unit instead of providing a self-contained unit.

U.S. Pat. No. 5,555,640, issued Sep. 17, 1996, to Ou, describes a household drying cabinet having a blower and a heating chamber. disposed on the cabinet top, generating forced and heated air downward into a drying chamber.

U.S. Pat. No. 5,870,836, issued Feb. 16, 1999, to Grimes, describes a portable clothes dryer useful in dry climates which unfolds to support a plurality of screen supports for clothing items and includes a fan for circulating dry air around the clothing items.

None of the above inventions and patents, taken either singly or in combination, is seen to describe the instant invention as claimed. Thus a low temperature clothes dryer solving the aforementioned problems is desired.

SUMMARY OF THE INVENTION

The low temperature clothes dryer of the present invention provides a movable cabinet, constructed of an insulative material, preferably wood, which includes a drying chamber, upper and lower airflow plenums, a dehumidifier, a duct. connecting one plenum to the dehumidifier, and another duct connecting the dehumidifier with the other plenum, thereby forming a closed air circulation loop. The drying chamber provides for removable horizontal screens for supporting clothing items and a hanging bar for hanging clothes to be dried. A timing control allows setting the time of operation of the drying cabinet. An electric heater with thermostat is provided to initially raise and maintain the air temperature within the drying chamber to at least about 90 degrees F. and maintains it at at least that temperature. The dehumidifier is then operated, providing for circulation through the ducts and drying cabinet by an internal fan. The dehumidifier has an evaporator through which warm, humid air is passed, thereby cooling the air and condensing water therefrom, the water being collected in a removable container or drained through a drain hose to a sewer. The fan then forces the cooled, dried air through a condenser which heats the dried air for recirculation through the drying chamber by means of ducts, thereby drying the clothing therein.

The compressor running the dehumidifier is located such that heat generated through its operation is vented to the atmosphere and not added to the circulating air. As the operation of the dryer proceeds, the temperature of the circulating air may increase to a point above which the clothing may be damaged. A temperature sensor and thermostat automatically shuts down operation of the dehumidifier if the temperature reaches above about 110 degrees F. A humidity sensor is also provided within the inlet duct for the dehumidifier, a switch being provided to turn off the dehumidifier upon the humidity lowering to a level indicating the clothes are dry.

Operation of the system may depend on environmental factors such as the ambient air temperature and humidity, the use of the electric heater being necessary in a cool environment to obtain and maintain a required minimum temperature. Operation of the dehumidifier within the humid environment of the dryer below a temperature of 65 to 70 degrees F. may result in freezing up of the evaporator and stoppage of air circulation. The separate electric heater obviates these problems. In a high ambient temperature, the temperature sensor may operate to periodically shut down the dehumidifier until the system cools below the maximum operation temperature. Venting heat produced by running the compressor avoids continually adding heat to the system and thus allows the operation of the dehumidifier during a higher percentage of the time, minimizing shutdown due to over-temperature of the circulating air. The present inventive drying cabinet may use a commercially available dehumidifier in its operation.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a low temperature clothes dryer, having a movable cabinet, and which includes a drying chamber, upper and lower airflow plenums, a dehumidifier, a duct connecting one plenum to the dehumidifier, and another duct connecting the dehumidifier with the other plenum, thereby forming a closed air circulation loop. The drying chamber provides for removable horizontal screens for supporting clothing items, and a hanging bar for hanging clothes to be dried.

Figure 1:
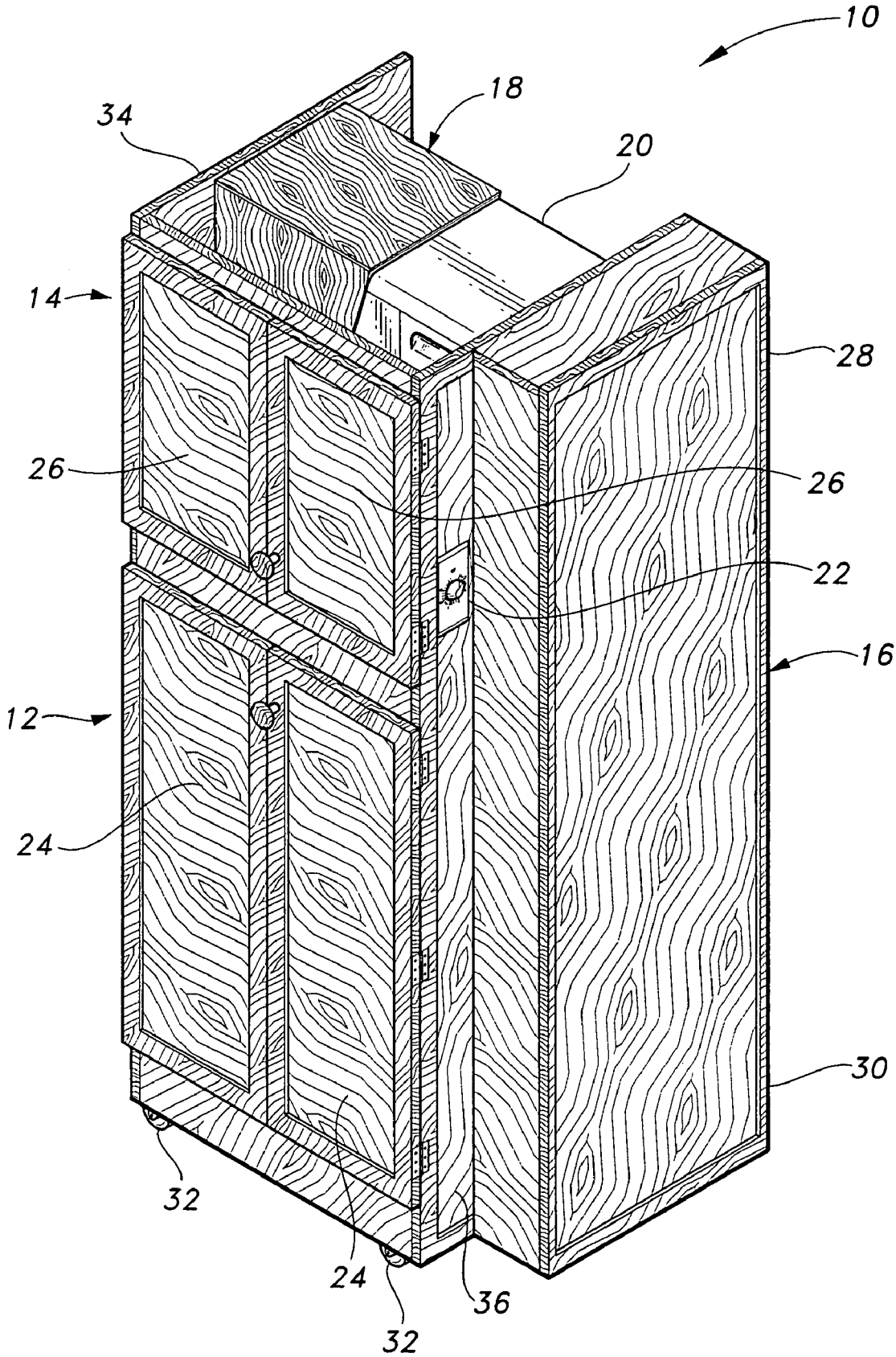
FIG. 1 is an environmental, perspective view of the low temperature clothes dryer according to the present invention.

Referring to FIG. 1, there is shown a perspective view of the low temperature clothes drying system of the present invention referred to by the reference number 10. The system includes a drying chamber 12, a dehumidifying module enclosure 14, a recycle duct 16, a wet air return duct 18 and a dehumidifier unit 20. A timer control 22 mounted on the dehumidifying enclosure allows setting time for operation of the system 10. Drying chamber 12 has doors 24 for access to the drying cabinet for placement and removal of clothing. Dehumidifying module enclosure 14 has doors 26 for access to the enclosure for inspection and removal of collected water. The recycle duct 16 has an upper portion 28 in communication with the dehumidifier 20 and a lower portion 30 in communication with the drying cabinet 12. The cabinet of the clothes dryer system 10 has wheels 32 for easy relocation of the system as desired. The cabinet has an outer sidewall 34, and an inner sidewall 36.

Figure 2:
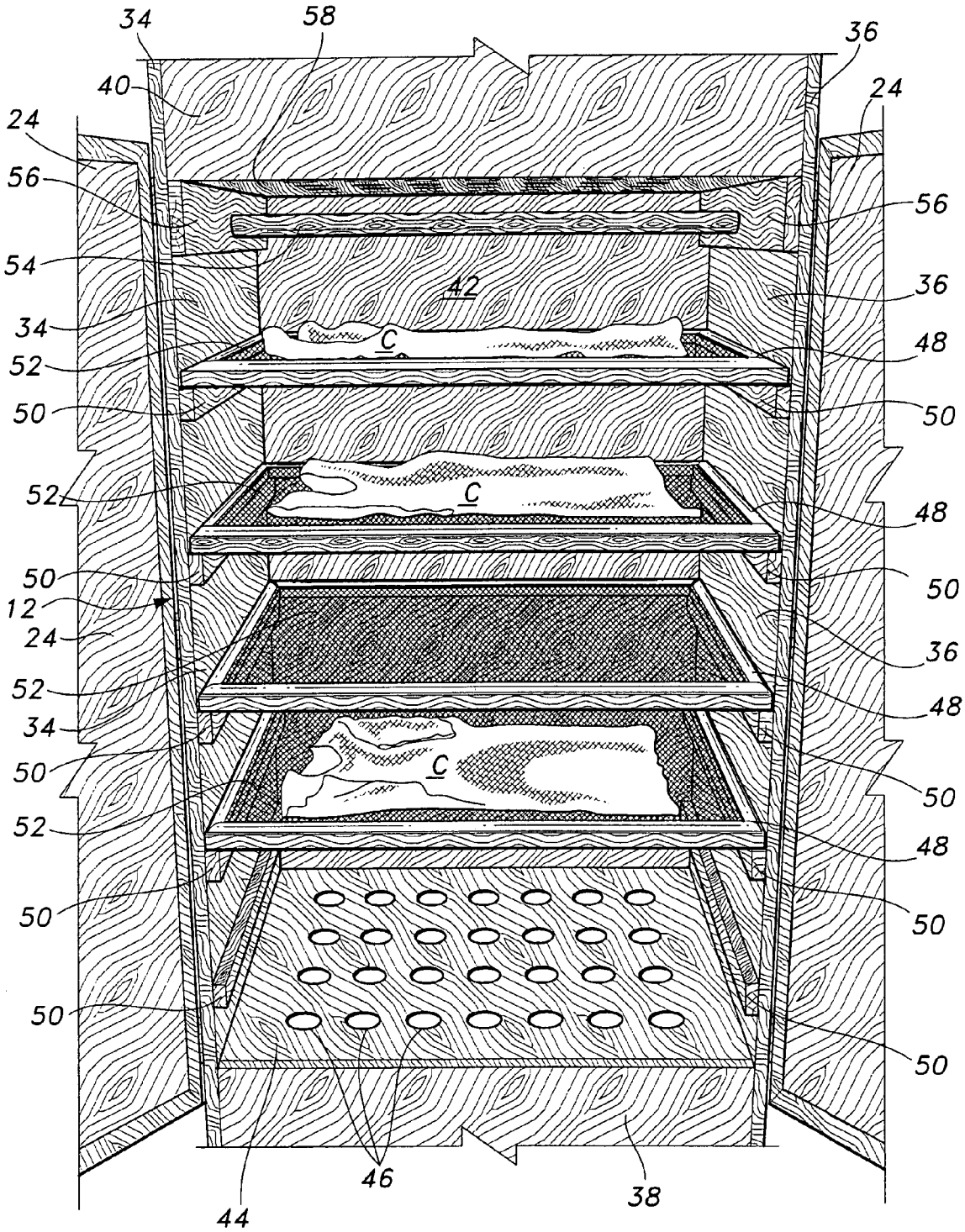
FIG. 2 is a lower frontal view of the drying chamber of the clothes dryer cabinet of FIG. 1 with the drying chamber doors open and clothes resting on drying shelves.

Referring to FIG. 2, there is shown a lower frontal view of the drying chamber 12 with clothes C laid flat for low temperature drying. Cabinet outer sidewall 34 and cabinet inner sidewall 36 support drying chamber doors 24 as shown in the open position. A lower plenum is formed by sidewalls 34 and 36 and front wall 38 and an upper plenum is formed by sidewalls 34 and 36 and front wall 40. Chamber 12 has a rear wall 42 which serves to form the rear of the upper and lower plenums (see FIG. 5). A lower plenum is formed between front wall 38, rear wall 42 and horizontal air flow distributing wall 44 having air distributing apertures 46 located within a substantial portion thereof for entry of air into the drying chamber 12. Drying frames 48 are held horizontally by supports 50 on cabinet outer sidewall 34 and inner sidewall 36 and spaced therealong. Drying frames 48 support screens 52 for holding clothing C horizontally in the drying airflow. It has been found the screens are superior to racks in that no impressions are formed in the drying clothing. A hanging bar 54 is supported between sidewalls 34 and 36 near the top of the drying chamber 12 by hanging bar supports 56 attached thereto. The top of the drying chamber 12 is formed by horizontally disposed upper plenum air receiving wall 58 having apertures 60 therethrough (see FIG. 3) substantially corresponding to apertures 46 of lower plenum air distributing wall 44. It has been discovered that the plenums act as air diffusers resulting in uniform airflow throughout the drying chamber with minimum dead spots, i.e., areas of stagnant air, by distributing the air upward in the manner obtained by the use of this lower and upper plenum system of the invention, thus obtaining consistent and uniform drying of clothes in minimum time with minimum power usage.

Figure 3:
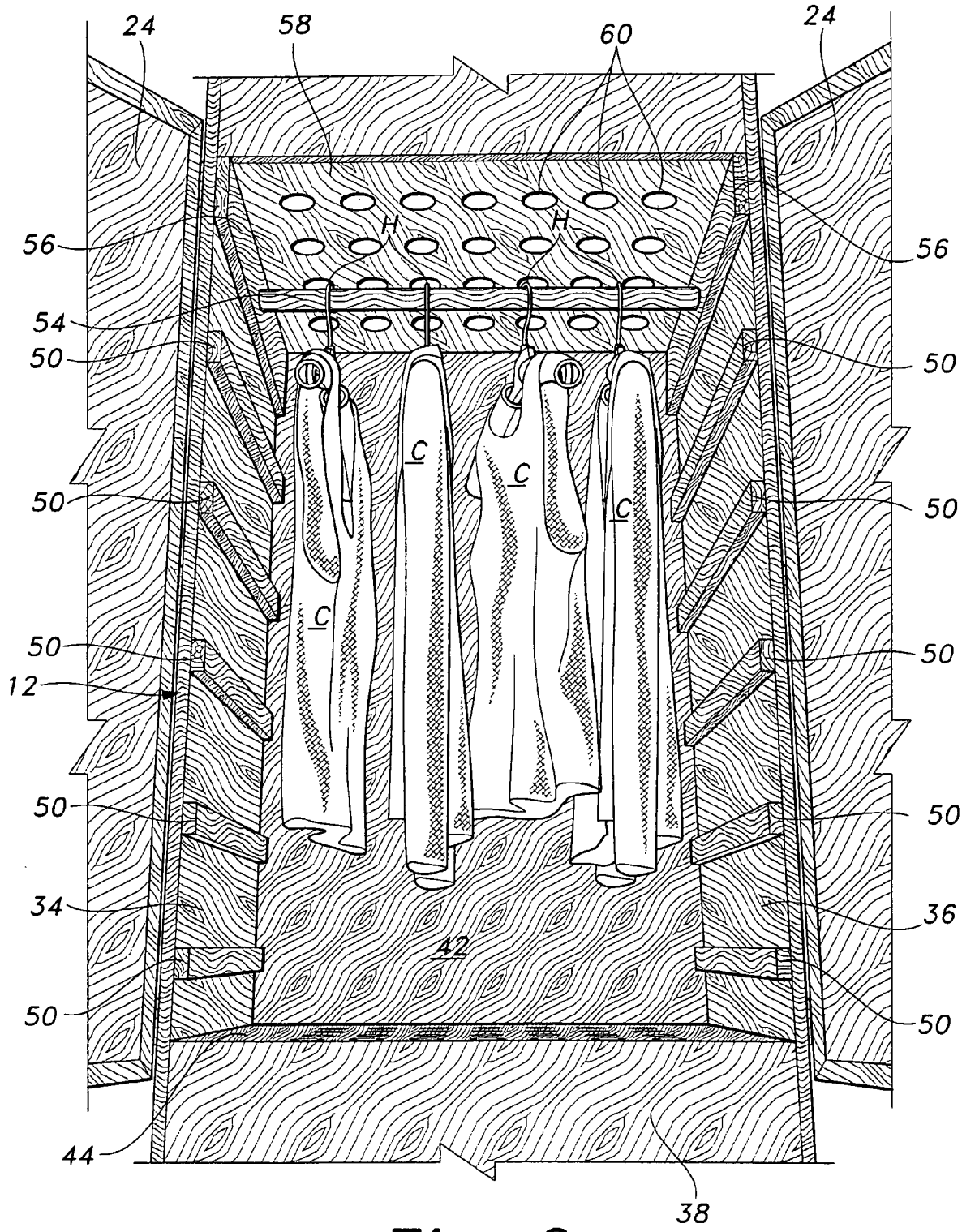
FIG. 3 is a lower frontal view of the drying chamber of FIG. 2, with clothes hung for drying.

Referring to FIG. 3, there is shown an upward frontal view of the drying chamber 12 similar to that of FIG. 2 with the drying frames and screens removed and clothing C hung for drying on hanging bar 54 by means of hangers H. As is more easily seen in this view, upper plenum air receiving wall 58 has apertures 60 distributed across its substantial portion similar to or identical to apertures 46 in lower plenum air distributing wall 44. The operation of the drying chamber 12 in this configuration is identical to that of the configuration of FIG. 2 with drying air moving uniformly upward through the chamber.

Figure 4:
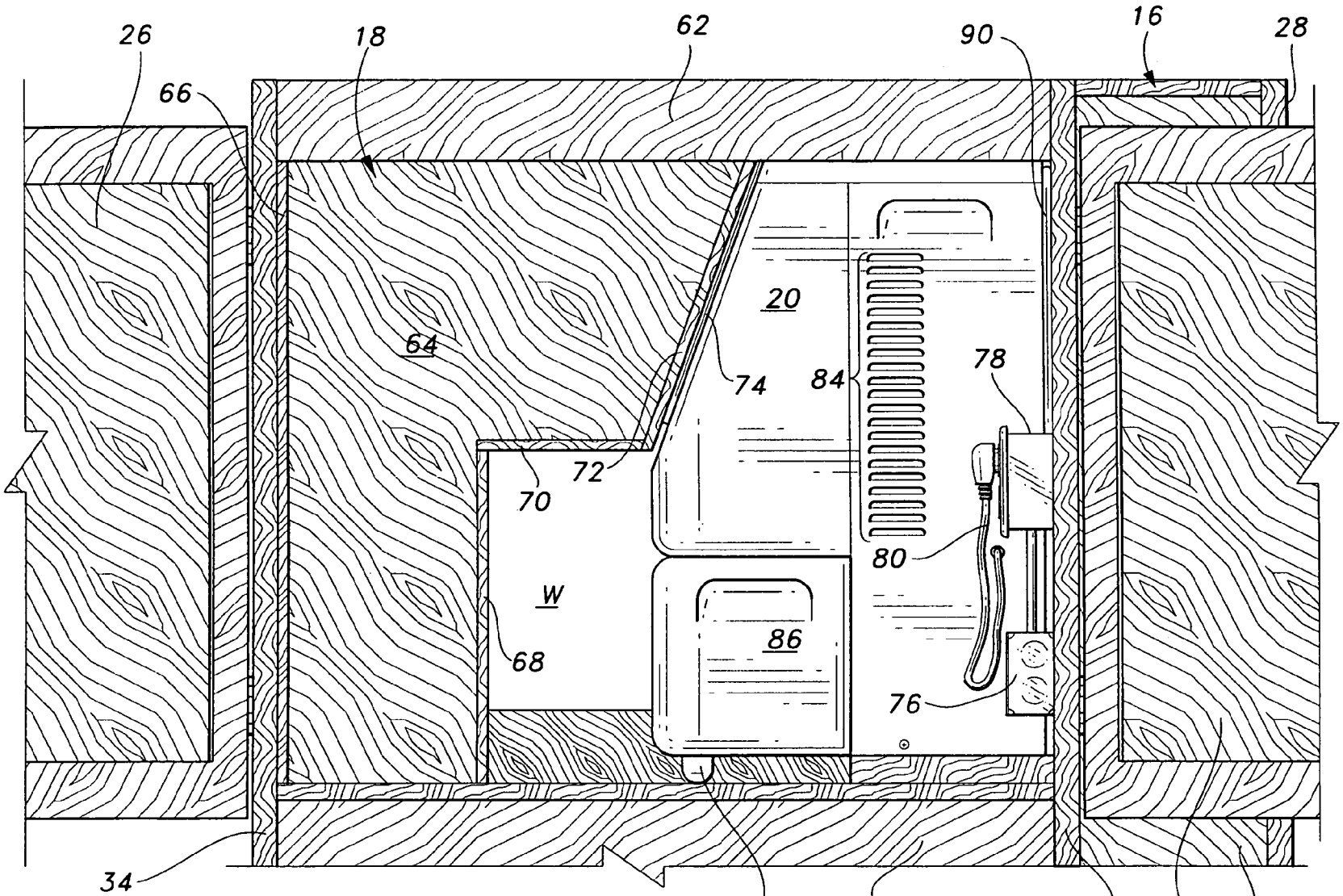
FIG. 4 is a frontal view of the upper dehumidifying module compartment showing wet air return, dehumidifier, and condensate collection tank.

Referring to FIG. 4, there is shown a frontal view of the dehumidifying module enclosure 14 (see FIG. 1) with doors 26 supported in the open position by outer wall 34 and inner wall 36. Wet air return duct 18 receives wet air from the upper plenum formed by sidewalls 34 and 36 and front wall 40 and directs the air to dehumidifier 20. An upper doorjamb 62 is provided between sidewalls 34 and 36 for support of the clothes dryer cabinet structure. Wet air return duct 18 has a front wall, 64, an outer sidewall 66, an inner sidewall 68, a return air diversion sidewall 70, and an outlet wall 72 as seen in FIG. 4. The wet air return duct 18 also has a rear wall 138 (see FIG. 5) and an upper wall 126 and is preferably integral when assembled so as to be removable from the dehumidifying module enclosure 14.

It is noted that the dehumidifying module enclosure has no top or rear wall, thus allowing compressor heat to vent through vents 84 to the environment. The amount of heat expelled to the environment is relatively small and would normally not present a problem in a normal room, garage, or basement.

A seal 74 is provided between the return air duct outlet wall 72 and the inlet to dehumidifier 20. Control 22 (see FIG. 1) is housed in control timer switch box 76 which controls electrical power to plug-in box 78 mounted on inner sidewall 36. Dehumidifier 20 supplied through electric power supply cord 80. Electrical power for operation of the clothes dryer system 10 is provided to control timer switch box 76 by operating power supply cord (not shown). Vents 84 are located in the wall of the housing of dehumidifier 20 which vent heat from operation of the compressor of the dehumidifier (see FIG. 5 and the related description below).

Condensation collection tank 86 is removable for emptying. When the tank has a liquid level switch(not shown) such that when the tank fills to a pre-determined level with condensate the dehumidifier 20 is shut off automatically. A hose fitting 88 is included which can be connected to a sewer system with a standard garden hose as desired. Seal 90 forms a seal between the outlet of the dehumidifier 20 and recycle duct 16 via an opening in inner wall 36 (see FIG. 5).

Figure 5:
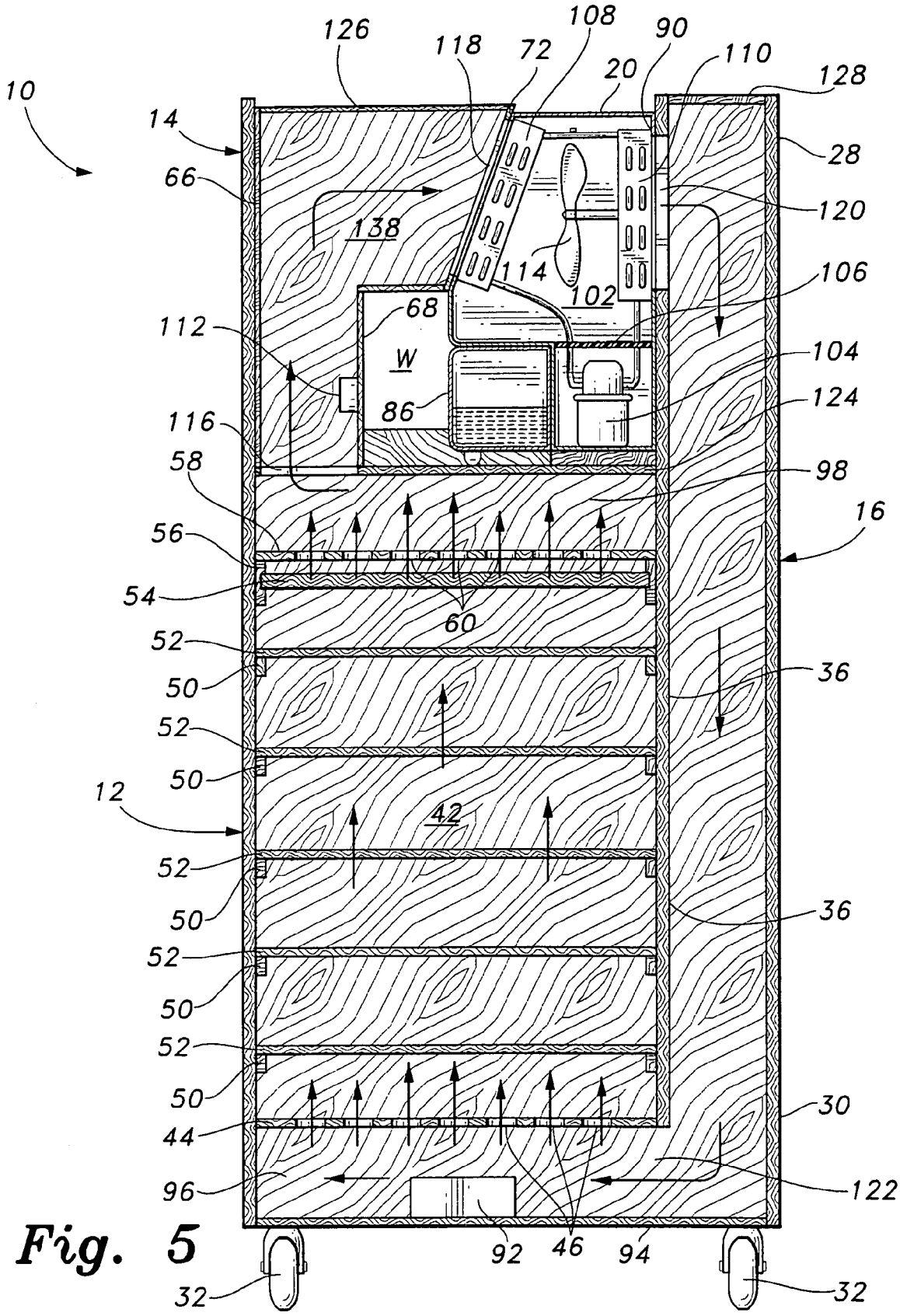
FIG. 5 is a sectional view of the drying cabinet and system having the dehumidifying module compartment on the top of the cabinet.

Referring to FIG. 5, there is shown a sectional view of the low temperature clothes dryer system 10. Drying cabinet 12 is shown with drying frame screens 52 as supported on supports 50 connected at corresponding levels along outer wall 34 and inner wall 36. Warm, dry air descends within recycle duct 16 through its lower portion 30 and into lower plenum 96 through lower plenum inlet 122. If the temperature of the air in lower plenum 96 is below a minimum temperature, thermostatic controlled electrical intermittent heater 92 heats the air to the desired minimum temperature. The dry air then is distributed below lower plenum wall 44 and enters drying chamber 12 through a plurality of air flow apertures 46.

The warm air becomes humid as it travels upward through screens 52 holding wet clothes C (see FIG. 2). A hanging bar 54 is located in the upper portion of the drying chamber 12 and is supported horizontal be corresponding hanging bar supports 54 mounted on outer wall 34 and inner wall 36. The hanging bar may be used to dry clothing C held by hangers, at least the upper drying frame screens being removed to provide clearance for the hung clothing. An upper plenum 98 collects the warm, humid air from drying chamber 36 through upper plenum wall 58 by means of apertures 60. The matching air distribution apertures 46 and 60 in the lower plenum 96 and upper plenum 98 allow for a relatively consistent and uniform flow of drying air upward through the drying chamber 12, avoiding "dead spots", i.e., locations where air is stagnant within the drying chamber.

The warm, humid air collected in upper plenum 98 enters wet air return duct 18 through upper plenum outlet 116 and flows upward past temperature and humidity sensors 112 mounted on inner sidewall 68. The return duct 18 has a back wall 138 and an upper wall 126 forming an integral, removable unit supported by upper plenum upper wall 124 and the inlet portion of dehumidifier 20. The wet air return duct 18 directs the upwardly traveling warm, wet air horizontally and out wet air return duct outlet 118 defined by return air duct outlet wall 72 and into the inlet of dehumidifier 20 where it is pulled through expansion coil condenser 108 by circulating fan 114. A seal 74 (see FIG. 4) is located between wet air return duct outlet wall 72 and the inlet (not shown) of dehumidifier 20 to avoid air leakage and insure total recycle of the drying air.

The cooled air flows through the dehumidifier interior 102 while condensate from the expansion coil condenser 108 is collected within condensate collection tank 86. The vented compressor 104 is separated from the recycling air flow by airflow-compressor baffle 106, the heat from which is vented through heat vents 84 formed in the outer casing of dehumidifier 20. This heated air is vented to the environment through the open upper and rear of dehumidifying module enclosure 14, a room wall W, for example being visible between the wet air return duct 18 and the dehumidifier 20. The cooled, dried recycle air within dehumidifier interior 102 is forced by circulating fan through heat radiator 110 for warming and out the dehumidifier air exit (not shown) through seal 90 into the upper portion 28 of duct 16 through recycle duct inlet 120. The air then travels downward through the recycle duct 16 to lower portion 30 where it is diverted into lower plenum 96 for introduction into drying chamber 18 as described above.

As shown, cabinet rear wall 42 forms the rear wall of drying chamber 12, upper plenum 98, recycle duct 16, and lower plenum 96. Cabinet base wall 94 forms the lower wall of recycle duct 16 and lower plenum 96, supports heater 92, and serves as an attachment point for wheels 32. Intermittent heater 92 may be activated during operation of the system 10 when the system is used in a cold ambient temperature to maintain minimum operational temperature. Intermittent heater 92 is optional in the system 10 when operated in normal room interior ambient temperatures as the operation of the dehumidifier alone will raise the temperature of the recycle air to a drying temperature over a period of time.

Figure 6:
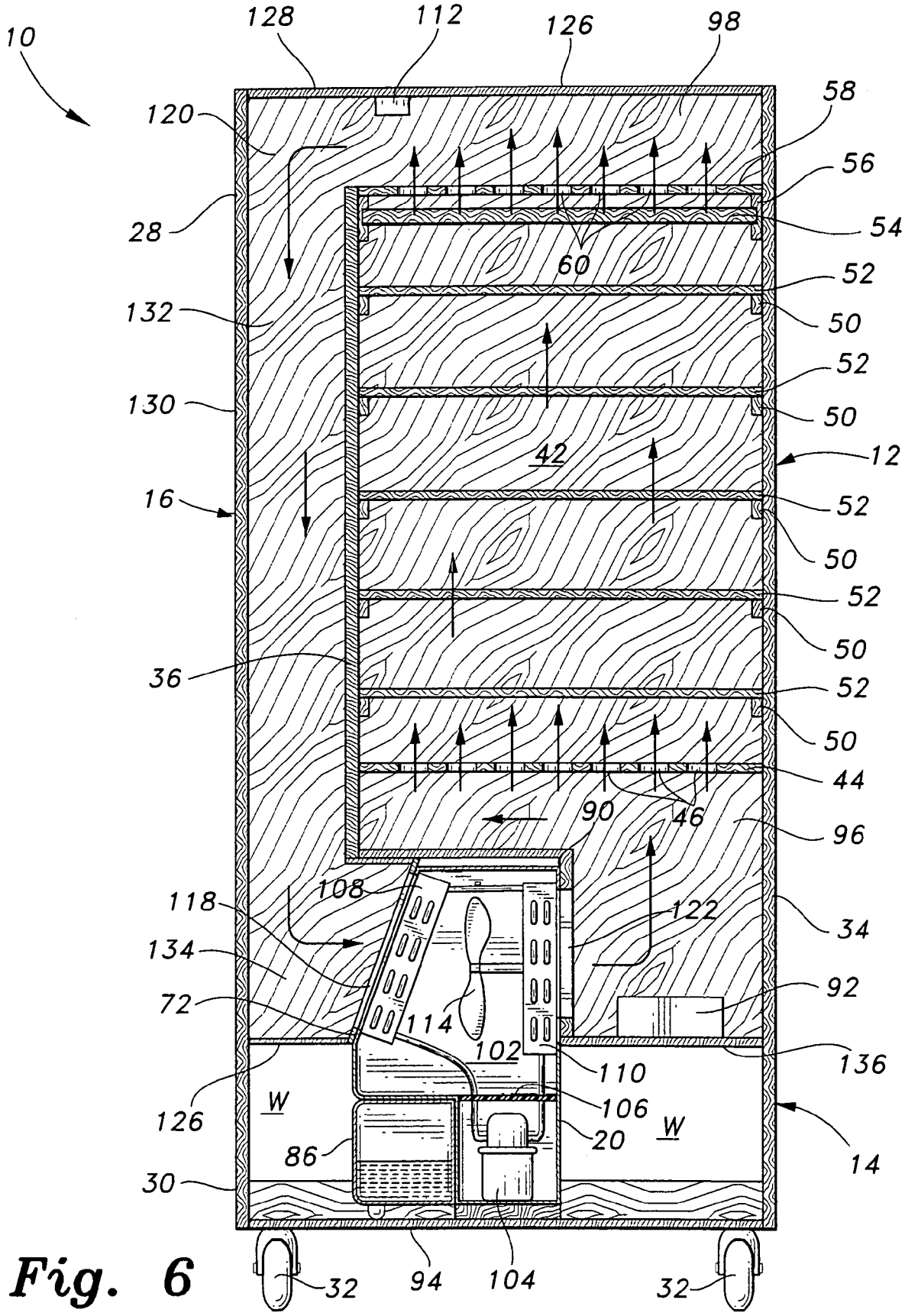
FIG. 6 is a sectional view similar to that of FIG. 6, showing the dehumidifying module compartment at the base of the cabinet.

Referring to FIG. 6, there is shown another embodiment of the present invention which is a variation of the embodiment of FIG. 5 with the dehumidifying module and enclosure moved to the lower portion of the dryer cabinet of the low temperature clothes dryer system 10. Reference numbers used in FIG. 6 refer to corresponding structure in the embodiment of FIG. 5. In this embodiment the dehumidifier 20 is supported by cabinet base wall 94. The recycle duct 16 is modified at its lower end to form a wet air return duct fluidly communicating with expansion coil condenser 108 of dehumidifier 20. A lower duct wall 126 extends inward from the recycle duct outer sidewall 130 to meet return air duct outlet wall 72. A seal similar to that of seal 74 (not shown) seals recycle duct outlet wall 72 with dehumidifier 20 for circulation of wet air through wet air return duct outlet 118 in direct fluid communication with expansion coil condenser 108.

Cooled, dehumidified air is forced through heat radiator 110 by the operation of recirculating fan 114 and travels through lower plenum inlet 122. Lower plenum 90 is extended downward to receive heated, dried air from inlet 122 and ends at heater support wall 136 which extends between outer wall 34 and dehumidifier 20. Heater 92 is supported on this wall. Drying chamber 12 is identical to that of FIG. 5 having a lower plenum air distribution wall 44 distributing drying air upward through removable horizontal drying frames 52 for drying clothing thereon. A hanging bar for hanging wet clothing is supported horizontally proximate the upper end of the drying chamber 12.

The wet air leaves drying chamber 12 by flowing upward through upper plenum air receiving wall 58 into upper plenum 98 bounded by upper plenum upper wall 126 which extends to form recycle duct upper wall 128. Wet air is diverted downward and directed through recycle duct inlet 120 in recycle duct 16 for return to dehumidifier 20. Drying chamber rear wall 42 extends to form the cabinet back wall including recycle duct rear wall 132 and the rear walls of lower plenum 96 and upper plenum 98. Temperature and humidity sensors 112 are mounted to upper wall 126. The power source and controls are identical to those of the embodiment of FIG. 5 and are not shown.

Figure 7:
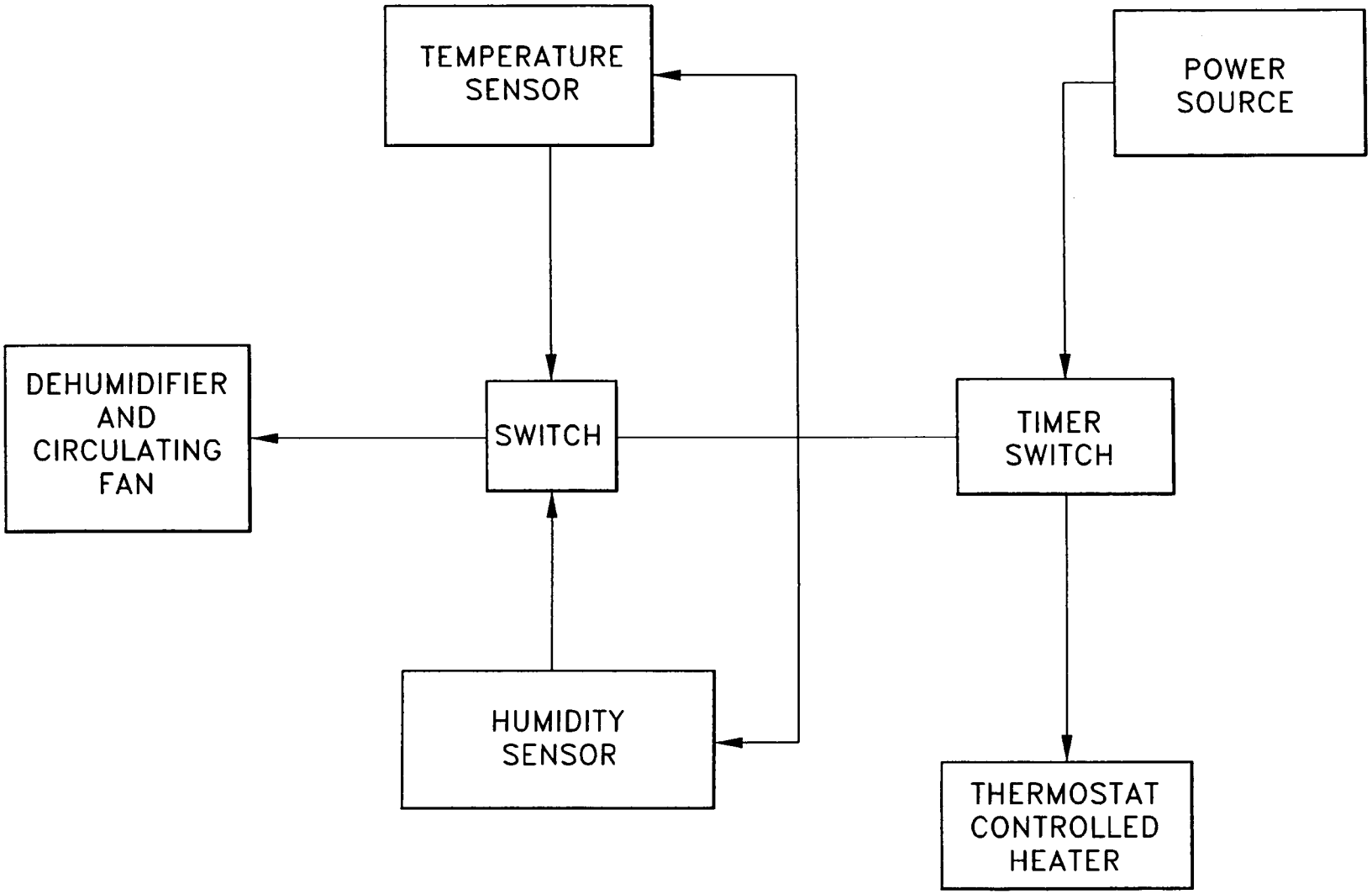
FIG. 7 is a diagram illustrating the relationship of power source, controls, sensors, and dehumidifier.

Referring to FIG. 7, there is shown a diagram illustrating the operation of the various sensors for control and operation of the inventive low temperature clothes dryer system 10. With the system connected to a power source a timer switch (22) may be turned to a desired time setting by the user. Power is supplied to the thermostat controlled heater 92 until the system is heated to a minimum of about 85 degrees F. In cold, unheated environments, the heater may cycle on occasionally to maintain at least the minimum operating temperature. Then power is supplied to a switch connected with the dehumidifier and its internal circulating fan for operation of the circulating drying system. A temperature sensor is located in the wet air return duct which opens the switch, disconnecting power to the dehumidifier. The temperature sensor is generally set at about 110 degrees F. so as to avoid damage to clothing. Upon the temperature sensor detecting an air temperature below 110 degrees F., the switch is closed, allowing the dehumidifier to operate. The humidity sensor is also located within the wet air return duct and detects when the humidity decreases to a low amount, indicating that the clothing is dry at which point the power switch to the dehumidifier and circulating fan is opened and the drying system shut down. The dry clothing is then ready for removal from the drying chamber of the system.

The low temperature clothes dryer of the present invention operates nearly as efficient in unheated areas as in a heated laundry room due to its closed circulation drying air design. The small electrical preheater may be sized for the intended dryer environment. None may be required for heated basements and laundry room, and small to medium heaters (<1000 watts) are required for intended dryer environments in cold climates in unheated areas. Under such cold climate environments the heater need be used only intermittently to maintain an acceptable temperature. High energy efficiency in power consumption is obtained in the present invention by recycling all circulating air, avoiding discharge of heated air into the environment.

The buildup of heat within the system so as to reach an unacceptably high temperature is avoided by selecting the proper capacity dehumidifying module, by considering the dimensions of the unit and the insulating characteristics of the cabinet material. When properly configured, the temperature of the unit levels off within the temperature range desired for low temperature drying of clothes. This results in the most energy efficient operation. Minor additional energy consumption takes place when the auxiliary, thermostatically controlled electric heater, if necessary, is used to maintain a minimum temperature of at least 65 to 70 degrees F. for operation, and the temperature sensor and dehumidifier shutdown switch operates to avoid temperatures over the maximum.

Energy consumption is minimized with the total recycle design of the present invention since the dehumidifier operates more efficiently with warm, humid, recycled air than with outside air introduced into the system. The warm air carries a high level of absolute humidity, resulting in a large gain in rate of water removal. Also introduction of outside air crossing the cooling/dehumidifying coils may be too cool, resulting in icing of the coils.

Power requirements of the unit of present invention are easily met by a 15 or 20 amp, 120V electrical service. The inventive dryer uses much less electrical energy than a conventional dryer, e.g., about 720 watts for the dehumidifier and much less than 1000 watts for the small intermittent heater, as compared to about 5600 watts for a 220V rotating drum, conventional clothes dryer. Even when the drying time in the inventive dryer is doubled or tripled as necessary for some articles, a significant savings in electrical energy is obtained when compared with a conventional clothes dryer. Another advantage over conventional dryers is that water vapor is not ducted into the environment, but is condensed and discharged to the water collection tank and may be drained to a sewer or retained for re-use where water supplies are scarce.

The inventive low temperature dryer as described above and shown in FIG. 5 employs a Whirlpool, Model AD 50USL, 50 pint/day dehumidifier requiring 6 amps. The dehumidifying module compartment is 24" high×24" deep× 28.75" wide. The upper plenum is 3½" high×24" deep× 28.75" wide. The lower plenum is 5½" high×24" deep× 28.75" wide. The unit as shown has gross dimensions of 82.5" high×36½" wide×25½" deep. The dehumidifier is 24" high, having intake and exit grill areas of 100 square inches and has a condensate tank 7"×8"×14". The cross section dimensions of the drying chamber and the corresponding drying racks are 28.5"×24" having 535 square inches of aluminum screen wire. The height of the drying chamber is about 45" in height. The unit described has a recycle duct having an inside area of 100 square inches (18"×5.5"). The cabinet is made of wood.

When the intermittent heater is not used, the dehumidified air is naturally heated by the dehumidifier such that, after an hour of operation, the temperature in the dryer raises to about 85 degrees F. depending on the material of the cabinet and the ambient temperature. In an ambient temperature less than 85 degrees F., operating temperatures have stayed below 100 degrees F. without intermittent shutdown due to the temperature sensor detecting an over-temperature.

It is to be understood that the present invention is not limited to the embodiments described above, but encompasses any and all embodiments within the scope of the following claims.

I claim:

1. A low temperature clothes dryer, comprising:

a generally rectangular drying chamber having opposed sidewalls, a rear wall, at least one front access door;

a plurality of pairs of drying frame supports spaced along said opposed walls of said drying chamber and a plurality of removable drying frame screens having drying frames horizontally supported by said pairs of drying frame supports;

an upper plenum, and a lower plenum, defining and being in communication with said drying chamber, wherein said lower plenum comprises a horizontal air flow distributing wall defining a plurality of air flow apertures communicating with the interior of said drying chamber, and wherein said upper plenum comprises a horizontal air flow receiving wall defining a plurality of air flow apertures communicating the said interior of said drying chamber;

a clothes hanging bar supported by a pair of hanging bar supports located on said opposed walls of said said drying chamber proximate said air flow receiving wall of said upper plenum;

a wet air return duct having an inlet connected with said rectangular drying chamber via said lower plenum and an outlet;

a dehumidifier connected with said outlet of said wet air return duct, said dehumidifier having an expansion coil condenser in fluid communication with said wet air return duct, a circulating fan, and a heat radiator;

a baffle within said dehumidifier and a compressor, said compressor being separated from the air circulating interior of said dehumidifier, said compressor being vented to the exterior of said clothes dryer so as to carry heat developed thereby to the surrounding atmosphere; and an air recycle duct having an inlet in fluid communication with said heat radiator of said dehumidifier and an outlet in fluid communication with said upper plenum, said air recycle duct having an upper portion and a lower portion, said upper portion being connected with said upper plenum, said lower portion forming a wet air return duct being in fluid communication with said expansion coil condenser of said dehumidifier;

said drying chamber, said wet air return duct, said dehumidifier, and said recycle duct forming a closed, circulating air drying system, said circulating air drying system being in the form of a cabinet, said cabinet forming a dehumidifying module enclosure beneath said drying chamber, said dehumidifying module being open at the rear for dissipation of heat from said compressor, said dehumidifying module having at least one front door for access to said dehumidifier.

2. The low temperature clothes dryer of claim 1, said lower plenum being further defined by a cabinet base wall, said opposed walls of said drying chamber including an outer wall extending from said base wall upward to form one sidewall of said dehumidifying module enclosure, and including an inner wall extending from said base wall upward to form the other sidewall of said dehumidifying module enclosure.

3. The low temperature clothes dryer of claim 1, further comprising an intermittent thermostatic electric heater located in said lower plenum.

4. The low temperature clothes dryer of claim 1, wherein said wet air return duct inlet is connected with said heat radiator of said dehumidifier.

5. A low temperature clothes dryer, comprising:

a generally rectangular drying chamber having opposed sidewalls, a rear wall, at least one front access door;

an upper plenum, and a lower plenum, defining and being in communication with said drying chamber;

a wet air return duct having an inlet connected with said rectangular drying chamber via said lower plenum and an outlet;

a dehumidifier connected with said outlet of said wet air return duct, said dehumidifier having an expansion coil condenser in fluid communication with said wet air return duct, a circulating fan, and a heat radiator;

an electrical power source for operation of said dehumidifier and a timer control electrically connected between said power source and said dehumidifier;

a humidity sensor and a temperature sensor located in said wet air return duct, each electrically connected with said dehumidifier via a switch wherein upon circulating wet air reaches a certain minimum humidity said dehumidifier is shut off by said switch, and wherein upon circulating wet air rises above a determined temperature, said dehumidifier is shut off by said switch, said switch starting operation upon the wet air temperature cooling below a set temperature; and an air recycle duct having an inlet in fluid communication with said heat radiator of said dehumidifier and an outlet in fluid communication with said upper plenum, said air recycle duct having an upper portion and a lower portion, said upper portion being connected with said upper plenum, said lower portion forming a wet air return duct being in fluid communication with said expansion coil condenser of said dehumidifier;

said drying chamber, said wet air return duct, said dehumidifier, and said recycle duct forming a closed, circulating air drying system.

* * * * *